United States Patent [19]

Masaki et al.

[11] Patent Number: 4,902,595

[45] Date of Patent: Feb. 20, 1990

[54] PHOTOSENSITIVE MEMBER HAVING AN OVERCOAT LYER AND PROCESS FOR MANUFACTURING THE SAME

[75] Inventors: Kenji Masaki; Izumi Osawa, both of Osaka; Yumiko Takedomi, Kobe; Masanori Fujiwara, Osaka, all of Japan

[73] Assignee: Minolta Camera Kabushiki Kaisha, Osaka, Japan

[21] Appl. No.: 218,821

[22] Filed: Jul. 12, 1988

[30] Foreign Application Priority Data

Jul. 15, 1987 [JP] Japan ..... 62-178047
Jul. 15, 1987 [JP] Japan ..... 62-178048
Jul. 15, 1987 [JP] Japan ..... 62-178049
Jul. 15, 1987 [JP] Japan ..... 62-178050

[51] Int. Cl.[4] ..... G03G 5/14

[52] U.S. Cl. ..... 430/66; 430/132; 430/130

[58] Field of Search ..... 430/66, 67, 132

[56] References Cited

U.S. PATENT DOCUMENTS 4,770,966 9/1988 Kazawa ..... 430/66

FOREIGN PATENT DOCUMENTS 1174171 12/1969 United Kingdom .

*Primary Examiner*—J. David Welsh

*Attorney, Agent, or Firm*—Burns, Doane, Swecker & Mathis

[57] ABSTRACT

A photosensitive member of the present invention comprising an electrically conductive substrate, a photosensitive layer comprising an organic material and a hydrogen-containing amorphous carbon overcoat layer containing halogen atoms and at least one or more elements selected from the group consisting of chalcogen and elements in Group III, IV and V of the periodic table.

The overcoat layer contains hydrogen in an amount of about 5 to about 50 atomic % based on the combined amount of hydrogen atoms and carbon atoms.

11 Claims, 3 Drawing Sheets

PHOTOSENSITIVE MEMBER HAVING AN OVERCOAT LYER AND PROCESS FOR MANUFACTURING THE SAME

BACKGROUND OF THE INVENTION

1. Field of the Invention:

The present invention relates to a photosensitive member comprising an overcoat layer on a photosensitive layer of organic materials.

2. Description of the Prior Art:

Remarkable progress has been made in the application of electrophotographic techniques since the invention of the Carlson process. Various materials have also been developed for use in electrophotographic photosensitive members.

Organic materials used for the construction of electrophotographic photosensitive members are well known to those skilled in the art (for example, the materials disclosed in the Dec. 15, 1986 issue of Nikkei New Materials, pages 83–98), and these materials have made superior photosensitive members practical from the standpoints of sensitivity, chargeability and construction costs.

Materials used in the construction of organic photosensitive members are, in general, photoconductive materials which produce an electric charge such as, for example, phthalocyanine series pigments, azo series pigments, perillene series pigments and the like, electrical charge transporting materials such as, for example, triphenylmethanes, triphenylamines, hydrazones, styryl compounds, pyrazolines, oxazoles, oxydiazoles, and the like, binding materials for dispersion coating such as, for example, polyester, polyvinyl butyral, polycarbonate, polyarylate, phenoxy, styrene-acryl, and other resins.

Repeated use of these types of photosensitive members, however, gives rise to problems of image defects, white streaks, and the like. These problems arise because the surface hardness of the organic photosensitive member roughly falls within the range from the 5B to B levels of the JIS standards for pencil lead hardness, thus the surface of the photosensitive member is readily damaged due to the friction which is generated when the member comes into contact with the transfer paper, cleaning components, developer, and the like. Another cause of such problems is the harsh surface contact made when paper jams occur and the resultant reversion to manual operation required to remedy the malfunction. Furthermore, damage to the surface of the photosensitive member results in a marked reduction in the surface potential of the member.

In order to eliminate these disadvantages, it is proposed that the surface of the photosensitive member be covered with a protective layer.

The technology described in U.S. Pat. No. 3,956,525 discloses a photosensitive member of the polyvinylcarbazole-selenium type coated with a polymer film having a thickness of 0.1 to 1 microns and formed by glow discharge polymerization as a protective layer.

The technology described in Unexamined Japanese Patent Publication SHO No. 60-61761 discloses a photosensitive member comprising a photactive layer covered by a diamond carbon layer.

The technology described in U.S. Pat. No. 4,544,617 discloses a photosensitive member comprising an amorphous silicon carrier generation and transport layer, trapping layer doped with boron or phosphorous, and an overcoating layer comprised of silicon nitride, silicon carbide or amorphous carbon.

Although the aforementioned manufacturing process disclosed in U.S. Pat. No. 3,956,525 improves the solvent resistance of the photosensitive member, moisture and friction resistances are inadequate, which gives rise to the disadvantages of image drift and cutting. Furthermore, there is no suggestion in the disclosure concerning the improvement of the disadvantages.

The photosensitive member disclosed in Unexamined Japanese Patent Publication SHO No. 60-61761 also has the disadvantages of poor moisture resistance and readily producing image drift.

On the other hand, most organic photosensitive members are poor in terms of heat resistance, that is to say, photosensitivity is reduced when such a member is subjected to a excessive high-temperature heating during the process for providing a protective overcoat layer. The technology disclosed in the aforementioned Unexamined Japanese Patent Publication SHO No. 60-61761 suggests a process for the manufacture of a photoactive layer wherein a diamond carbon layer is successively formed on an amorphous silicon layer normally manufactured at 150° to 300° C. When this process is used on an organic photosensitive member, however, it presents the disadvantage in that the photosensitivity of said member is completely lost.

The photosensitive member disclosed in the aforesaid U.S. Pat. No. 4,544,617 also has poor moisture resistance which has the disadvantage of leading to the production of image drift. This process cannot be applied to the organic photosensitive members because the substrate is subjected to high temperatures during the overcoat layer formation process.

An organic photosensitive member has a relatively soft and easily damaged surface and does not possess an overcoating protective layer which is effective in preventing the production of image drift during long-term use.

SUMMARY OF THE INVENTION

The main object of the present invention is to provide a photosensitive member the surface of which will not be damaged with repeated use and which has superior resistance to environmental factors.

Another object of the invention is to provide a photosensitive member which will not give rise to image drift.

Still another object of the invention is to provide a photosensitive member having an overcoat layer which will not peel off due to mechanical contact or fluctuations in moisture or temperature when used in a copying machine.

A still further object of the invention is to provide a process for the manufacture of a photosensitive member having an organic photosensitive layer and a protective overcoat layer formed thereon without harm to the sensitivity characteristics of the organic photosensitive layer.

These and other objects of the invention can be accomplished by providing a photosensitive member comprising an electrically conductive substrate, a photosensitive layer formed of organic material and an overcoat layer formed on the photosensitive layer and comprising amorphous carbon containing hydrogen, halogen and one or more elements selected from the group consisting of chalcogen and elements in Group III, IV and V of the periodic table.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
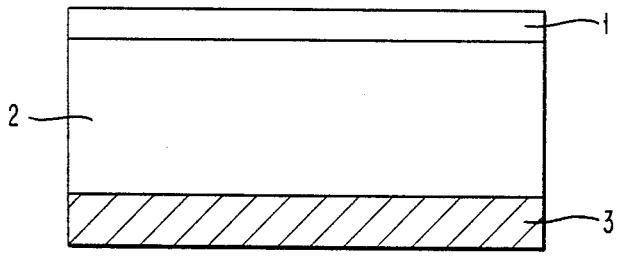
FIG. 1 is a diagram showing a photosensitive member embodying the invention.

FIG. 1 shows an example of the construction of a photosensitive member of the present invention wherein a conductive substrate 3 has sequentially laminated thereon a photosensitive layer 2 and an overcoat layer 1 formed of an amorphous hydrocarbon layer.

A photosensitive layer 2 is provided on a conductive substrate 3 thereby forming an organic photosensitive member, and the interior construction of said photosensitive layer 2 may be a functionally separated construction having a laminated charge producing layer and a charge transporting layer, a binder-type construction having a charge producing material and charge transporting material dispersed throughout a binding material, or other construction.

The conductive substrate 3 may be at a minimum a material which is conductive on its outermost surface, and may be cylindrical, flexible belt, flat plate, or other arbitrary shape.

The characteristics of the present invention is an overcoat layer 1 having halogen atoms and at least one or more elements selected from the group of chalcogen and elements in Group III, IV and V of the periodic table in an amorphous carbon layer (hereinafter referred to as an a-C layer).

The amorphous carbon layer itself has a hardness rating of 4H, but becomes harder and damage resistant by means of the addition of halogen atoms and at least one or more elements selected from the group of chalcogen and elements in Group III, IV and V of the periodic table, the addition of said atoms providing an overcoat layer 1 which has comparatively superior moisture resistance, assures suitable chargeability, and has superior transparency to light.

The halogen atoms may be fluorine, chlorine, bromine, or iodine atoms. Fluorine atoms in particular provide exceptionally superior results from the standpoint of moisture resistance.

The effective moisture resistance imparted by the addition of fluorine atoms is thought to be obtained from the introduction of strongly water-repellent fluorine atoms into the layer and the increased density of the layer due to a dehydration reaction induced by the fluorine atoms in the layer.

The a-C layer of the present invention contains 0.01 to 50 atomic %, preferably 0.1 to 10 atomic %, and ideally 0.5 to 5 atomic % of halogen atoms based on the total amount of constituent atoms of the entire structure.

The content of less than 0.01 atomic % of the halogen atoms is undesirable in view of moisture resistance. If the amount of halogen atoms exceeds 50 atomic % based on all the constituent atoms of the a-C layer, the appropriate layer formation cannot necessarily be assured.

Although the doping of halogen atoms results in improved moisture resistance, it does not afford sufficient characteristics in view of actual use of a photosensitive member.

More specifically, the a-C layer containing halogen atoms possesses excellent moisture resistance at the time of starting the use of the member and sufficient intensity of film after repeated use under environmental conditions of room temperature and room humidity. However, moisture resistance after a long use is not sufficient. Our inventors have found that the image drift may be produced under environmental conditions of 35° C. temperature and 80% of humidity after 10,000 copies were made.

This may be caused from the fact that film resistance toward the direction of the surface is reduced because water is attached thereto by breaking weak bonds formed in the layer due to corona discharge.

The present invention further adds at least one or more atoms selected from the group consisting of chalcogen atoms and elements in Group III, IV and V of the periodic table to the a-C layer in order to improve moisture resistance after repeated use.

The chalcogen atoms may be sulfur, selenium or tellurium atoms. The Group III elements may be boron, aluminum, gallium, indium or thallium atoms. The Group IV elements may be silicon, germanium, tin or lead atoms. The Group V elements may be phosphorus, arsenic, antimony or bismuth atoms. These atoms are believed to have their weak bonds forcibly broken and reformed during the reaction without bond dissociation induced by corona discharge and the like due to the formation of strong bonds between chalcogen/carbon atoms, Group III/carbon atoms, Group IV/carbon atoms and Group V/carbon atom with the result that moisture adhesion is prevented.

For this reason it is preferable that these atoms be used as separate material gases, to wit, it is desirable to conduct the reaction with the atoms in a temporarily dissociated state.

The amounts of chalcogen atoms and elements in Group III and V of the periodic table to be present in the a-C layer of the present invention is preferably about 0.01 to 20 atomic %, more preferably about 0.1 to 10 atomic %, and most preferably about 0.5 to 5 atomic % based on all the constituent atoms of the a-C layer.

The amount of elements in Group IV of the periodic table to be present in the a-C layer of the present invention is preferably about 0.01 to 40 atomic %, more preferably about 0.1 to 15 atomic %, and most preferably about 0.5 to 5 atomic % based on all the constituent atoms of the a-C layer.

The content of less than 0.1 atomic % of these atoms is undesirable in view of moisture resistance after repeated use. If amounts of chalcogen atoms exceeds 20 atomic % or amounts of elements in Group IV exceeds 40 atomic % based on all the constituent atoms of the a-C layer, the suitable transparency to light cannot necessarily be assured. Further, if amounts of elements in Group III and V exceeds 20 atomic % based on all the constituent atoms of the a-C layer, the appropriate layer formation cannot necessarily be assured.

Although there is no particular limitation on the amount of the above-mentioned atoms which may be contained in the a-C layer, the amount is necessarily restricted from the perspectives of the overcoat layer manufacturing and glow discharge processes.

Although there is no particular limitation on the amount of the hydrogen atoms which may be contained in the a-C layer, the amount is necessarily restricted from the perspectives of the overcoat layer manufacturing and glow discharge processes, said amount being, in general, 5 to 50 atomic %.

The contents of these atoms in the a-C layer can be determined by a usual method of elementary analysis, e.g. Auger electron spectroscopy or SIMS analysis. In addition to halogen atoms, the a-C layer may contain chalcogen atoms and elements in Group III, IV and V of the periodic table singly, and may contain two or more of the above types of atoms. The addition of Group III or V can control the polarity adjustment of the a-C layer. Moreover, the incorporation of chalcogen atoms can prevent the optical fatigue and filming phenomenon. The a-C layer containing elements in Group IV is free of deterioration over a prolonged period of time and exhibits improved durability.

The overcoat layer 1 of the present invention is formed at a thickness of 0.01 to 5 microns, preferably 0.05 to 2 microns, and ideally 0.1 to 1 microns. A layer with a thickness of less than 0.01 micron has reduced hardness and is readily damaged. Also, a layer with the thickness exceeding 5 microns has reduced transparency to light and causes reduced sensitivity of the photosensitive member because the exposed light cannot be effectively conducted to the organic photosensitive layer.

The overcoat layer 1 of the photosensitive member of the present invention may be formed on an organic photosensitive member, thus achieving the objects of the present invention.

The aforesaid halogen atoms, chalcogen atoms and elements in Group III, IV and V may be incorporated so as to be distributed uniformly throughout the width of said overcoat layer 1 or may be incorporated in uneven distribution. When distributed unevenly, the region having the majority of these atoms in the direction of the layer thickness shall have these atoms in such amounts that they are within the ranges heretofore described.

High density distribution of halogen atoms in the vicinity of the surface of the layer in particular can be effected by post-layer formation plasma surface processing of the molecules containing the halogen atoms, in which case high density distributions of 40 to 50 atomic % is possible.

The overcoat layer 1 is formed by means of a glow discharge process. The overcoat layer 1 is formed by discharging at reduced pressure gaseous-phase molecules containing at least carbon atoms and molecules containing hydrogen atoms together with molecules containing halogen atoms and molecules containing at least one or more elements selected from the group consisting of chalcogen and elements in Group III, IV and V, thereby diffusing on the substrate the activated neutral atoms and charged atoms in the plasma production region, and being induced by electrical or magnetic force or the like to form on the substrate in solid phase via a recombination reaction. The formation of the overcoat layer 1 can be regulated via the aforesaid plasma reaction (hereinafter referred to as a P-CVD reaction) to form an amorphous hydrocarbon layer incorporating halogen atoms and at least one or more elements selected from the group consisting of chalcogen and elements in Group III, IV and V of the periodic table.

These hydrocarbons need not always be in a gaseous phase at room temperature at atmospheric pressure but can be in a liquid or solid phase insofar as they can be vaporized on melting, evaporation or sublimation, for example, by heating or in a vacuum. Examples of useful hydrocarbons are saturated hydrocarbons, unsaturated hydrocarbons, alicyclic hydrocarbons, aromatic hydrocarbons and the like. Such hydrocarbons are usable in combination.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-(dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methyl-allene, butadiene, pentadiene, hexadiene, cyclopentadiene and the like; triolefins such as ocimene, alloocimene, myrcene, hexatriene and the like; acetylene, methylacetylene, 1-butyne, 2-butyne, 1-pentyne, 1-hexyne, 1-heptyne, 1-octyne, 1-nonyne, 1-decyne, butadyine and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinenesesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

Considering the formation of a layer of good quality, unsaturated hydrocarbons are desirable because they are reactive. Especially, the most desirable compounds are butadiene and propylene in view of film-forming ability, ease of gas handling and cost.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the alternating electric field to be set up, increasing the intensity of a d.c. electric field superposed on the alternating electric field or desired combination of such procedures.

The halogen compounds to be used need not always be in a gaseous phase at room temperature at atmospheric pressure but can be in a liquid or solid phase insofar as they can be vaporized on melting, evaporation or sublimation, for example, by heating or in a vacuum. While halogens such as fluorine, chlorine, bromine and iodine are usable in this invention, examples of useful halogen compounds are inorganic compounds such as hydrogen fluoride, chlorine fluoride, bromine fluoride, iodine fluoride, hydrogen chloride, bromine chloride, iodine chloride, hydrogen bromide, iodine bromide and hydrogen iodide; and organic compounds such as alkyl halides, aryl halides, styrene halides, polymethylene halides, haloforms, halogen substituted hydrocarbons and the like. Examples of such alkyl halides are methyl fluoride, methyl chloride, methyl bromide, methyl iodide, ethyl fluoride, ethyl chloride, ethyl bromide, ethyl iodide, propyl fluoride, propyl chloride, propyl bromide, propyl iodide, butyl fluoride, butyl chloride, butyl bromide, butyl iodide, amyl fluoride, amyl chloride, amyl bromide, amyl ioide, hexyl fluoride, hexyl chloride, hexyl bromide, hexyl iodide, heptyl fluoride, heptyl chloride, heptyl bromide, heptyl iodide, octyl fluoride, octyl chloride, octyl bromide, octyl iodide, nonyl fluoride, nonyl chloride, nonyl bromide, nonyl iodide, decyl fluoride, decyl chloride, decyl bromide, decyl iodide and the like. Examples of useful aryl halides are fluorobenzene, chlorobenzene, bromobenzene, iodobenzene, chlorotoluee, bromotoluene, chloronaphthalene, bromonaphthalene and the like. Examples of useful styrene halides are chlorostyrene, bromostyrene, iodostyrene, fluorostyrene and the like. Examples of useful polymethylene halides are methylene chloride, methylene bromide, methylene iodide, ethylene chloride, ethylene bromide, ethylene iodide, trimethylene chloride, trimethylene bromide, trimethylene iodide, dibutane chloride, dibutane bromide, dibutane iodide, dipentane chloride, dipentane bromide, dipentane iodide, dihexane chloride, dihexane bormide, dihexane iodide, diheptane chloride, diheptane bromide, diheptane iodide, dioctane chloride, dioctane bromide, dioctane iodide, dinonane chloride, dinonane bromide, didecane chloride, didecane iodide and the like. Examples of useful haloforms are fluoroform, chloroform, bromoform, iodoform and the like.

Useful examples of halogen substituted hydrocarbons are carbon tetrafluoride, vinylidene fluoride, perfluoroethylene, perfluoropropane, perfluoropropylene, difluoropropane, and the like.

From the perspectives of film-forming ability, ease of gas handling and cost, the most desirable compounds are carbon tetrafluoride, perfluoroethylene, perfluoropropylene and the like.

The amount of halogen atoms incorporated in the amorphous carbon layer can be regulated at least by means of increasing or decreasing the amount of molecules containing halogen atoms used in the P-CVD reaction.

Examples of molecules containing at least chalcogen atoms are $H_2S$, $CH_3(CH_2)_4S(CH_2)_4CH_3$, $CH_2{=}CHCH_2SCH_2CH{=}CH_2$, $C_2H_5SC_2H_5$, $C_2H_5SCH_3$, thiophene, $H_2Se$, $(C_2H_5)_2Se$, $H_2Te$ and the like.

From the perspectives of film-forming ability, ease of gas handling and cost, the most desirable compounds are $H_2S$, $H_2Se$ and the like.

Examples of molecules containing at least III element of the periodic table are $B_2H_6$, $BCl_3$, $BBr_3$, $BF_3$, $B(OC_2H_5)_3$, $AlCl_3$, $Al(Oi\text{-}C_3H_7)_3$, $(CH_3)_3Al$, $(C_2H_5)_3Ga$, $(C_2H_5)_3In$ and the like.

From the perspectives of film-forming ability, ease of gas handling and cost, the most desirable compounds are diborane, trimethylaluminum and the like.

Examples of molecules containing at least IV element of the periodic table are $SiH_4$, $GeH_4$, $SiF_4$, $GeF_4$, $Si_2H_6$, $Si_2F_2H_4$, $Si(OCH_3)_4$, $Ge(OCH_3)_4$, $GeH_4$, $GeF_4$, $Ge_2H_6$, $(OC_2H_5)_4Sn$, $Sn(OCH_3)_4$ and the like.

From the perspectives of film-forming ability, ease of gas handling and cost, the most desirable compounds are silane, germane and the like.

Examples of molecules containing at least Group V elements of the periodic table are $PH_3$, $PF_3$, $PF_5$, $PCl_2F$, $PCl_2F_3$, $PCl_3$, $PBr_3$, $PO(OCH_3)_3$, $P(C_2H_5)_3$, $POCl_3$, $AsH_3$, $AsCl_3$, $AsBr_3$, $AsF_3$, $AsF_5$, $AsCl_3$, $SbH_3$, $SbF_3$, $SbCl_3$, $Sb(OC_2H_5)_3$ and the like.

From the perspectives of film-forming ability, ease of gas handling and cost, the most desirable compounds are phosphine, arsine and the like.

The amount of these atoms, i.e., chalcogen atoms and III, IV and V atoms of the periodic table, incorporated in the a-C layer can be regulated at least by means of increasing or decreasing the amount of molecules containing these atoms in the P-CVD reaction.

Figure 2:
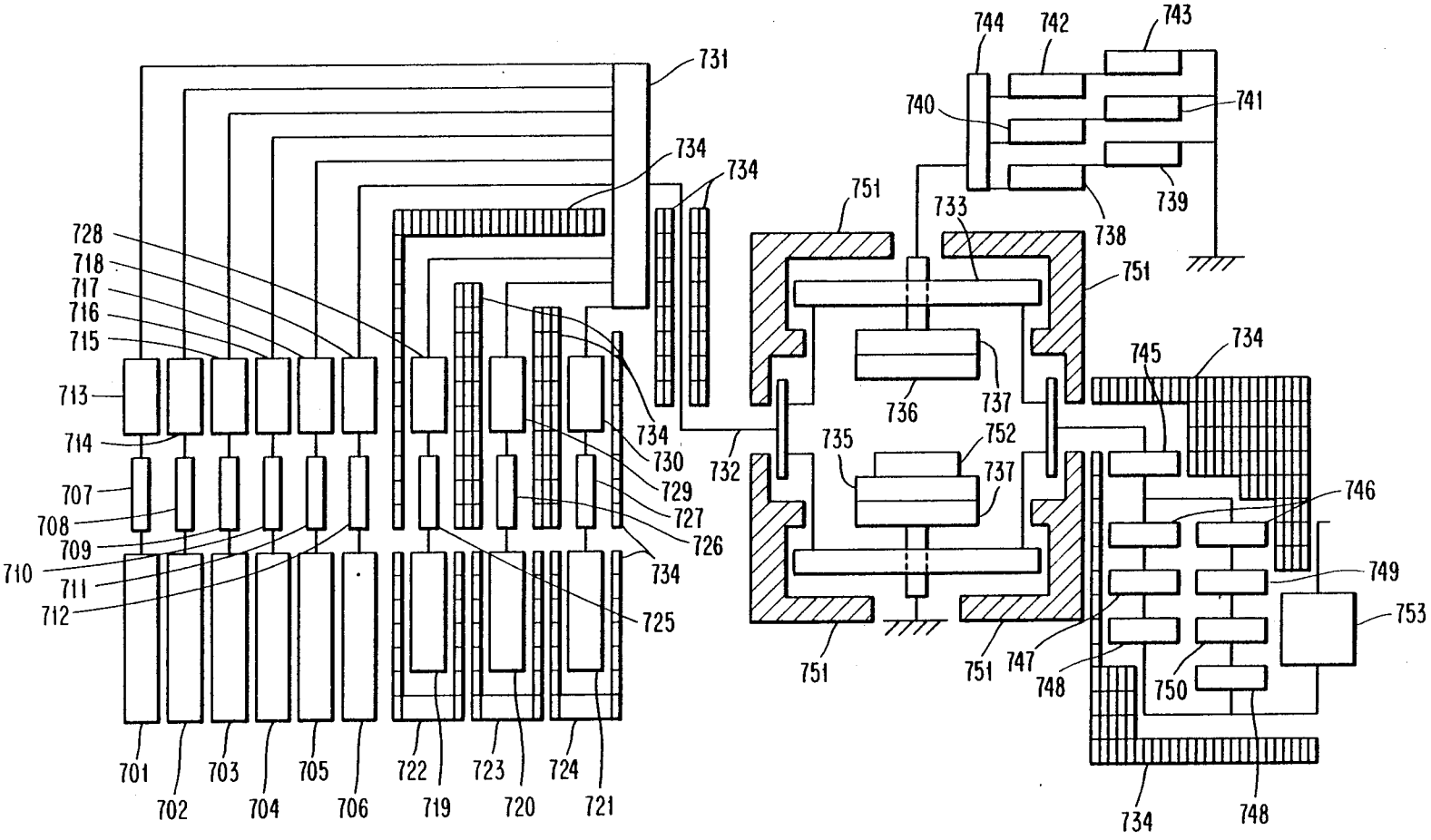
FIGS. 2 and 3 are diagrams showing apparatus for preparing photosensitive members of the invention.
Figure 3:
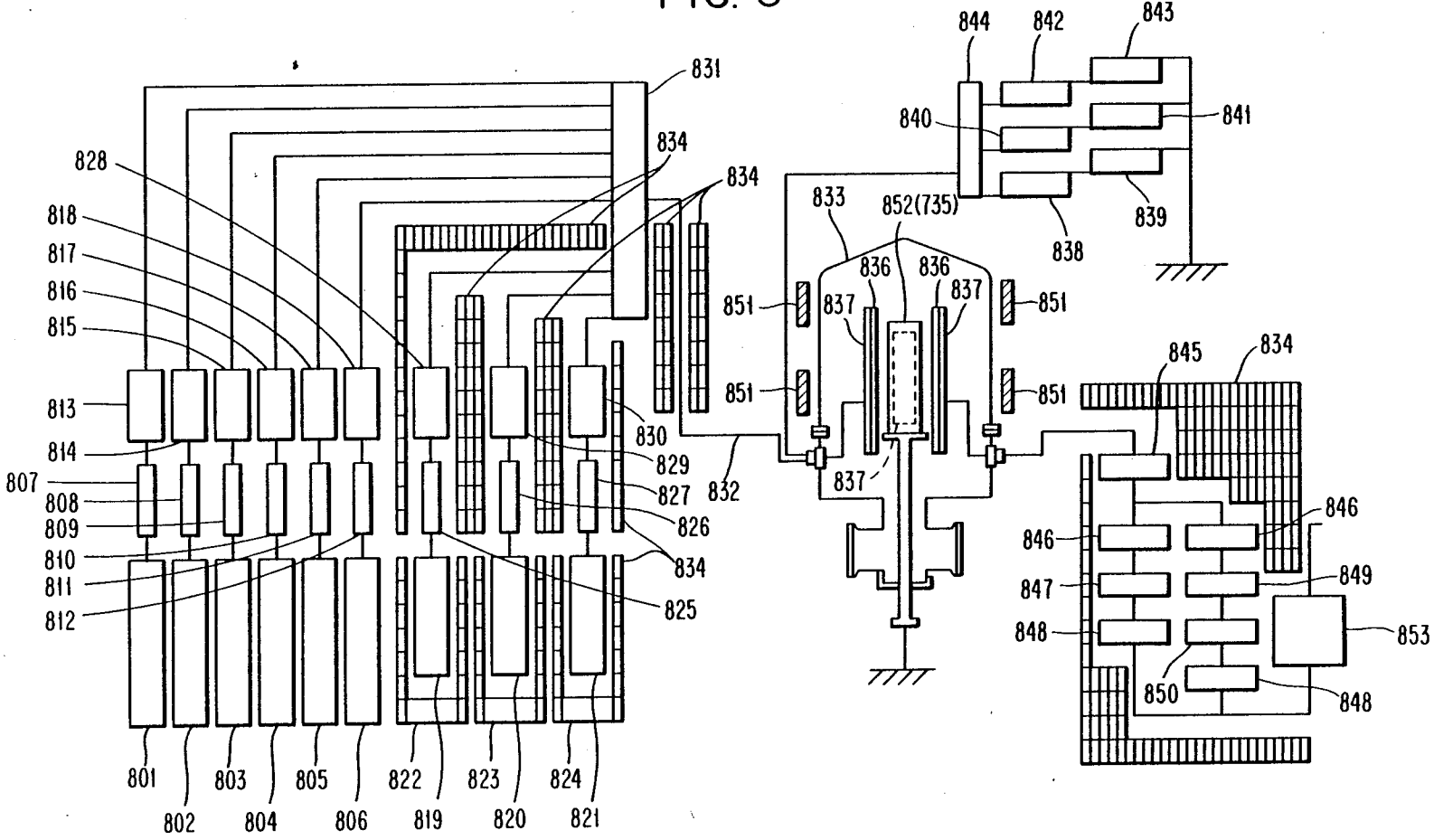

FIGS. 2 and 3 show single examples of a glow discharge decomposition apparatus for forming the overcoat layer of the present invention. FIG. 2 shows a plane-parallel plate P-CVD apparatus and FIG. 3 shows a cylindrical P-CVD apparatus.

First, an explanation of the apparatus shown in FIG. 2 follows hereinafter.

FIG. 2 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies, for example, a low frequency of 1 KHz to 1 MHz, or a high frequency of 13.56 MHz and the like is applicable to the electrode 736 by way of a connection selecting switch 744. Direct electrical power may also be additionally applied.

According to the present invention, the a-C layer can be formed on the organic photosensitive layer under the substrate temperature of 100° C. or less by applying alternating power of at least 1 KHz to 1 MHz. When a high-frequency power of 1 MHz is applied, powder particles are produced, so that the a-C layer cannot be formed. On the other hand, the application of a low-frequency power of less than 1 KHz cannot cause the glow discharge, failing to form the a-C layer.

The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting value 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor.

Heaters may be selected according to the characteristics of the starting material gases to be used, but they are often unnecessary, particularly when the vaporization point of the starting material gases under normal pressure is −50° C. to +15° C., thus allowing the simplification of the manufacturing apparatus.

In general, the provision of the aforesaid heater types is preferred in order to prevent production of a fine powder polymer within the reactor 733 when the vaporization point of the starting material gases is lower than −50° C., and to prevent coalescence within the various piping when the vaporization point of the starting material gases is higher than +15° C.

Although FIG. 2 shows that the substrate 752 is fixed to the grounded electrode 735, the substrate may be attached to the power application electrode 736, or to both the electrodes.

FIG. 3 shows another type of apparatus for preparing the photosensitive member of the invention. This apparatus has the same construction as the apparatus of FIG. 2 with the exception of the interior arrangement of the reactor 833. The numerals shown by 700 order in FIG. 2 are replaced by the numerals at 800 order in FIG. 8. With reference to FIG. 3, the reactor 833 is internally provided with a hollow cylindrical electrically conductive substrate 852 serving also as the grounded electrode 735 of FIG. 2 and with an electrode heater 837 inside thereof. A power application electrode 836, similarly in the form of a hollow cylinder, is provided around the substrate 852 and surrounded by an electrode heater 837. The conductive substrate 852 is rotatable about its own axis by motor from outside.

The reactors shown in FIGS. 2 and 3 for preparing the photosensitive member are first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature. In order to prevent heat conversion of the organic photosensitive layer at this time, it is desirable that the substrate temperature be set at 100° C. or less (room temperature to 100° C). A photosensitive member comprising a conductive substrate having a photosensitive layer provided thereon may be used. It is most desirable that the substrate temperature be set at 40° C. to 60° C. in order to eliminate the affect of the change of the room temperature according to every season.

Subsequently, material gases are fed into the reactor from the first to sixth tanks and the first to third containers (i.e. from those concerned), each at a specified flow rate, using the flow controllers concerned, i.e. first to ninth flow controllers and the interior of the reactor is maintained in a predetermined vacuum, i.e., about 0.05 to 5.0 torr by the pressure control valve. After the combined flow of gases has become stabilized, the high-frequency power source, for example, is selected by the connection selecting switch to apply a low-frequency power to the power application electrode. This initiates discharge across the two electrodes, forming a solid layer on the substrate with time. The layer deposition rate is 10 angstroms/min to 3 microns/min, min, with a range of 100 angstroms/min to 1 micron/min being preferable, and a range of 500 angstroms/min to 5000 angstroms/min being ideal. A layer deposition rate of less than 10 angstroms/min is undesirable from a production standpoint, while a rate greater than 3 microns/min is undesirable because it gives rise to layer unevenness. The discharge is discontinued upon the thickness reaching the desired value. Consequently, the a-C layer of the invention is obtained which serves as an overcoat layer.

A photosensitive member overcoating layer of the present invention manufactured by the aforesaid process is clearly non-crystalline as determined by the peak x-ray diffraction, contains carbon as well as hydrogen as structural atoms as determined by the peak infrared absorption based on the absorption spectrum of the carbon and hydrogen bonds, said layer is thus understood to be an amorphous hydrocarbon layer.

Furthermore, the peak absorption for a photosensitive member overcoating layer of the present invention manufactured by the aforesaid process may also be measured based on the content of halogen, chalcogen, III, IV and V elements, and carbon bonds as determined via the infrared absorption spectrum.

It is preferred that a photosensitive member overcoating layer of the present invention has a dielectric constant of about 2.0 to 6.0, with an optical band gap of about 1.5 to 3.0 [eV].

The present invention will be described with reference to the following examples.

First, the organic photosensitive layers A through I were manufactured.

Manufacture of Organic Photosensitive Layer A

A fluid mixture of 1 g of chlorodian blue (CDB) as a disazo pigment, 1 g of polyester resin (Toyobo Co., LTD., V-200), and 100 g of cyclohexanone were dispersed in a sand grinder for 13 hours. A cylindrical aluminum substrate measuring 80×330 mm was dipped in the fluid dispersion so as to be coated with a 0.3 micron thick film after drying, said film was then dried to form the charge generating layer.

Next, 1 g of 4-diethylaminobenzaldehyde diphenylhydrazone (DEH) and 1 g of polycarbonate (Teijin Kasei Co., K-1300) were dissolved in 6 g of THF, and the solution was applied over the charge generating layer so as to form a layer of 15 micron thickness after drying, said application was then dried forming a charge transporting layer and an organic photosensitive layer A is thus obtained.

COMPARATIVE EXAMPLE 1

The organic photosensitive layer A obtained by the previously described process was subjected to an initial charge of −600 V using the corona discharge during the normal Carlson process. The measured amount of light required to reduce the surface potential by half (hereinafter referred to as El/2) was 2.0 lux-sec., and the residual potential (hereinafter referred to as Vr) was −5 V. Also, the photosensitive member A had a surface hardness ratings of approximately 5B based on measurements for pencil lead hardness as provided in Japanese Industrial Standards JIS K-5400. When the photosensitive member A was installed in actual copying machines (Minolta Model EP470Z) and subjected to resistance tests comprising the making of 5,000 A4 size copies, a loss of layer thickness of approximately 2.0 microns was observed. From these results, it can be understood that although the organic photosensitive member of the present invention was observed to possess superior electrostatic characteristics, the member was observed to be poor in durability.

Manufacture of Organic Photosensitive Layer B

Organic photosensitive layer B was manufactured in substantially the same manner as was the layer A with the exception of substituting methyl methacrylate PMMA (Mitsubishi Rayon Co., Ltd. BR-85) for the polycarbonate used to form the charge transporting layer.

COMPARATIVE EXAMPLE 2

Evaluations of the organic photosensitive layer B were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer C

Organic photosensitive layer C was manufactured in substantially the same manner as was the layer A with the exception of substituting polyarylate (Unichika LTD., U-4000) for the polycarbonate used to form the charge transporting layer.

COMPARATIVE EXAMPLE 3

Evaluations of the organic photosensitive layer C were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer D

Organic photosensitive layer D was manufactured in substantially the same manner as was the layer A with the exception of substituting polyester (Toyobo Co., LTD., V-200) for the polycarbonate used to form the charge transporting layer.

COMPARATIVE EXAMPLE 4

Evaluations of the organic photosensitive layer D were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer E

A fluid mixture of 25 parts by weight of specific α-type copper phthalocyanine (Toyo Ink Manufacturing Co, LTD.,), 50 parts acrylmelamine thermosetting resin (Dainippon Ink and Chemicals, Inc., a mixture of A-405 and Super Bekkamin J-8200), 25 parts 4-diethylaminobenzaldehyde diphenylhydrazone, and 500 parts organic solvent (a mixture of 7 parts xylene and 3 parts butanol) was pulverized and dispersed in a ball mill for 10 hours. A cylindrical aluminum substrate measuring 80 mm in diameter by 330 mm in length was dipped in this fluid dispersion so as to be coated with a film having a thickness of 15 microns after drying, said film was then baked 1 hour at 150° C., whereby the organic photosensitive layer E was obtained.

COMPARATIVE EXAMPLE 5

Evaluations of the organic photosensitive layer E were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer F

A fluid dispersion of 2 parts dis-azo compound (G-1) as shown in Table 2-1, 1 part polyester resin (Toyobo Co., V-500), and 100 parts methyl ethyl ketone, was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 angstroms, thereby forming a charge producing layer.

Next, a coating comprising 10 parts hydrazone compound (T-1) as shown in Table 2-2 and 10 parts polycarbonate resin (Teijin Kasei Co., K-1300) dissolved in 80 parts tetrahydrofuran was applied to the charge generating layer so as to form a layer having a thickness of 20 microns after drying, said layer then being dried to form a charge transporting layer, thereby forming the organic photosensitive layer F.

COMPARATIVE EXAMPLE 6

Evaluations of the organic photosensitive layer F were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer G

A fluid dispersion of 2 parts dis-azo compound (G-2) as shown in Table 2-1, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 2,500 angstroms, thereby forming a charge generating layer.

Next, a coating comprising 10 parts stilbene compound (T-2) as shown in Table 2-2 and 10 parts polyarylate resin (Unichika Co., U-4000) dissolved in 85 parts tetrahydrofuran was applied to the charge generating layer so as to form a layer having a thickness of 20 microns after drying, said layer then being dried to form a charge transporting layer, thereby forming the organic photosensitive layer G.

COMPARATIVE EXAMPLE 7

Evaluations of the organic photosensitive layer G were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer H

A fluid dispersion of 2 parts dis-azo compound (G-3) as shown in Table 2-1, 1 part polyester resin (Toyobo Co., V-500), and 100 parts methyl ethyl ketone was subjected to a dispersion process using a ball mill for 24 hours. A cylindrical aluminum substrate measuring 80 mm in diameter by 330 mm in length was coated with this fluid dispersion via a dipping process so as to form a film layer having a thickness of 3,000 angstroms, thereby forming a charge generating layer.

Next, a coating comprising 10 parts stilbene compound (T-3) as shown in Table 2-2 and 10 parts methyl methacrylate resin (Mitsubishi Rayon, BR-85) dissolved in 80 parts tetrahydrofuran was applied to the charge generating layer so as to form a layer having a thickness of 20 microns after drying, said layer then being dried to form a charge transporting layer, thereby forming the organic photosensitive layer H.

COMPARATIVE EXAMPLE 8

Evaluations of the organic photosensitive layer H were conducted using the same criteria as for Comparative Example 1; the results are shown in Table 1.

From these results, it can be understood that although the organic photosensitive member of the present invention was observed to possess superior electrostatic characteristics, the member was observed to be poor in durability.

Manufacture of Organic Photosensitive Layer I

Titanylphthalocyanine (TiOPc) underwent vacuum deposition using a heat resistance process at a boat temperature of approximately 400° to 500° C. in a vacuum of $10^{-4}$ to $10^{-6}$ torr, with the resulting TiOPc deposition film having a thickness of 2,500 angstroms forming charge generating layer.

Then, 1 part p,p-bisdiethylaminotetraphenylbutadiene, having the chemical structure shown hereinafter in [A], and 1 part polycarbonate (Teijin Kasei Co., K-1300) were dissolved in 6 parts THF, and a coating of the solution was applied to the aforesaid charge generating layer so as to form a film having a thickness of 15 microns after drying, said film then being dried to form a charge transporting layer, thereby forming an organic photosensitive layer I.

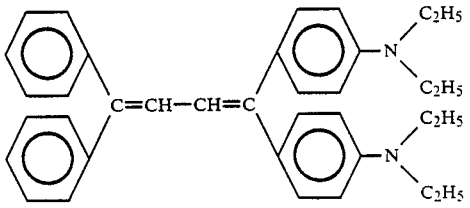

[A]

TABLE 2-1

Charge Producing Materials

G-1

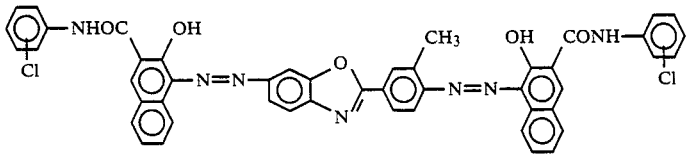

G-2

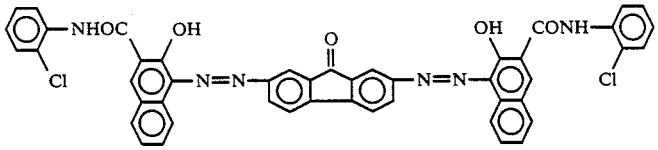

TABLE 2-1-continued

Charge Producing Materials

G-3

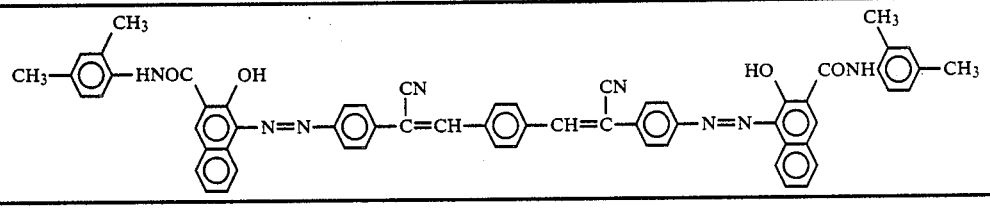

TABLE 2-2

Charge Transporting Materials

T-1

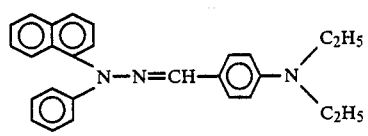

T-2

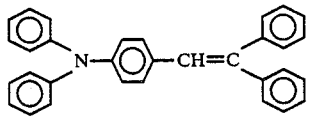

T-3

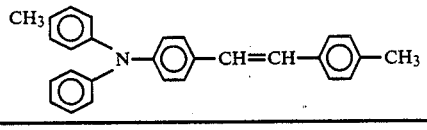

COMPARATIVE EXAMPLE 9

The organic photosensitive layer I obtained by the previously described process was subjected to an initial charge $V_0$ of $-600$ V using the corona discharge during the normal Carlson process. The amount of light required to reduce the surface potential by half (E1/2) was measured using a semiconductor laser with a wavelength of 780 nm with the E1/2 equalling 4.9 ergs/cm$^2$, and the residual potential Vr was 5 V. Also, the organic photosensitive layer of Comparative Example 9 had surface hardness ratings of approximately 5B based on measurements for pencil lead hardness as provided in Japanese Industrial Standards JIS K-5400. When the photosensitive member obtained in Example 9 was installed in actual copying machines (Minolta Model EP470Z with the optical system modified with a polygon mirror scanning-type semiconductor laser) and subjected to resistance tests comprising the making of 10,000 A4 size copies, a loss of layer thickness of approximately 2.0 microns was observed.

From these results, it can be understood that although the organic photosensitive member of the present invention was observed to possess superior electrostatic characteristics, the member was observed to be poor in durability.

The results are shown in Table 1. The use of semiconductor laser light as an exposure light source is indicated by the [*] mark next to the E1/2 value [erg/cm$^2$].

TABLE 1

| Comparative Example | V0 (V) | E½ (lux-sec) | Vr (V) | Hardness | Film Loss (μm) |
|---|---|---|---|---|---|
| Ex. 1 | −600 | 2.0 | −5 | 5B | 2.0 |
| Ex. 2 | −600 | 6.2 | −12 | B | 1.3 |

TABLE 1-continued

| Comparative Example | V0 (V) | E½ (lux-sec) | Vr (V) | Hardness | Film Loss (μm) |
|---|---|---|---|---|---|
| Ex. 3 | −600 | 2.3 | −8 | 5B | 2.5 |
| Ex. 4 | −600 | 2.2 | −7 | 5B | 2.0 |
| Ex. 5 | +600 | 4.3 | +5 | B | 1.0 |
| Ex. 6 | −600 | 1.8 | −5 | 5B | 2.0 |
| Ex. 7 | −600 | 1.0 | −4 | 5B | 1.8 |
| Ex. 8 | −600 | 2.1 | −7 | 5B | 2.2 |
| Ex. 9 | −600 | 4.9* | −5 | 5B | 2.0 |

(Evaluations conducted for layer loss after 10,000 printings.)

EXAMPLES 1 to 9

Using a glow discharge decomposition apparatus shown in FIG. 3, an overcoat layer of the present invention for a photosensitive member was prepared.

First, the interior of the reactor 733 was evacuated to a high vacuum of about $10^{-6}$ torr, and the first, second, third and fourth regulator valves 707, 708, 709 and 710 were thereafter opened to introduce hydrogen gas from the first tank 701, butadiene gas from the second tank 702, tetrafluorocarbon gas from the third tank 703 and diborane gas from the fourth tank 704 into the first flow controller 713, the second flow controller 714, the third flow controller 715 and the fourth flow controller 716 respectively at an output pressure of 1.0 kg/cm$^2$. The dials on the flow were adjusted to supply the hydrogen gas at a flow rate of 300 sccm, the butadiene gas at 30 sccm, the tetrafluorocarbon gas at 90 sccm and the diborane gas at 3 sccm to the reactor 733 through the main pipe 732 via the intermediate mixer 731. In the member of Example 5, phosphine gas for adjusting chargeability was simultaneously introduced into the reactor 733 at a flow rate of 3 sccm. After the flows of the gases were stabilized, the internal pressure of the reactor 733 was adjusted to 0.5 torr by the pressure control valve 745. On the other hand, the organic photosensitive layers A (Example 1), B (Example 2), C (Example 3), D (Example 4), E (Example 5), F (Example 6), G (Example 7), H (Example 8) and I (Example 9) were used as the substrate 752, said substrate being preheated to a temperature of 50° C. for 15 minutes before the introduction of these gases. With the gas flow rates and the pressure in stabilized state, 160-watt power with a frequency of 70 KHz was applied to the power application electrode 736 from the low-frequency power source 741 preconnected thereto by the selecting switch 744 to conduct plasma polymerization for 2 minutes, forming an a-C layer, 0.2 microns in thickness, as an overcoat layer. After completion of the film formation, the power supply was discontinued, the regulator valves except for the one for hydrogen gas were all closed. Then, only the hydrogen gas was introduced into the reactor 733 at a flow rate of 200 sccm with a pressure of 20 Torr to decrease the temperature of the substrate to 30° C. for about 15 minutes. Thereafter, the regulator valves for hydrogen gas was closed, whereupon the vacuum was broken and the photosensitive member of the present invention was removed.

When subjected to organic quantitative analysis and Auger electron spectroscopy, the a-C layers thus obtained were found to contain 45 atomic % of hydrogen atoms, 3.7 atomic % of halogen atoms, i.e., fluorine atoms and 0.8 atomic % of element in Group III, i.e., boron atoms based on all the constituent atoms contained therein. Further, the a-C layer of Example 5 was found to contain 0.6 atomic % of phosphorus atoms based on all the constituent atoms contained therein.

Characteristics:

The overcoat layers obtained in Examples 1 to 9 had a surface hardness of about 6H based on measurements for pencil lead hardness as provided in Japanese Industrial Standards JIS K-5400, and it is understood that the high degree of surface hardness was a marked improvement.

Further, photosensitivity of the members obtained in each Example is almost the same as shown in Comparative Examples 1 to 9. This indicates that the overcoat layer of the photosensitive member according to the present invention does not impair the inherently superior sensitivity of the organic photosensitive layer.

In addition, the photosensitive members obtained in Examples 1 to 9 were exposed to atmospheric conditions of low temperature-low humidity (10° C. and 30% humidity) and high temperature-high humidity (50° C. and 90% humidity) which were alternated every 30 minutes each over a 6 hour period, and cracking or separation of the overcoat layer was not observed, from which results it is understood that the photosensitive member having the overcoat layer of the present invention has superior adhesive properties regarding its adhesion to the organic photosensitive layers.

When the photosensitive members obtained in Examples 1 to 9 were installed in the copy machine employed for evaluating the members of Comparative Examples 1 to 9, clear images were obtained. In addition, so-called image drift was not observed when copies were made under environmental conditions of 35° C. temperature and 80% humidity. Neither was any separation of the overcoat layer noted when said layer came into contact with the developer, copy paper, and cleaning components within the copy machine.

Evaluations after 10,000 copies, 50,000 copies, 100,000 copies or 250,000 copies, each test being conducted at 35° C. and 80% relative humidity, revealed no evidence of image drift, confirming the superior temperature resistance after printing.

It can be understood from the aforesaid data that the photosensitive member having an overcoat layer of the present invention achieves durability without loss of image quality, and that it particularly provides superior performance in regard to moisture resistance after printing.

EXAMPLES 10 to 75

Photosensitive members were prepared as similarly as with Example 1, each member comprising an organic photosensitive layer and an overcoat layer provided in this order as shown in FIG. 1.

Table 3 shows the various condition values for forming an overcoat layer. Table 4 shows the conditions different from Example 1 for forming an overcoat layer and classified into 19 items (1) to (19). These items are described at the top column of the Table. Some condition values shown at each item are common to each example, while others are varying each example.

Table 3 shows the items (1) to (19) as follows:

(1) flow rate of hydrogen gas from the first tank (701) (sccm)
(2) flow rate of material gas from the second tank (702) (sccm)
(3) flow rate of dopant gas from the third tank (703) (sccm)
(4) flow rate of dopant gas from the fourth tank (704) (sccm)
(5) flow rate of dopant gas from the fifth tank (705) (sccm)
(6) flow rate of dopant gas from the first container (719) (sccm)
(7) temperature of the first heater (722) (°C.)
(8) pressure (Torr)
(9) temperature of the substrate (°C.)
(10) time for heating the substrate (minute)
(11) power (watt)
(12) time for plasma polymerization (minute)
(13) thickness of the layer (micron)
(14) frequency from the power source (KHz)
(15) hydrogen content (atomic %)
(16) to (18) content of dopant contained in the overcoat layer (atomic %)
(19) organic photosensitive layer Molecular formulas shown in Table 1 represent following compounds:

$C_3H_6$: propylene
$C_3F_6$: perfluoropropylene
$(CH_3)_3Al$: trimethylaluminum
$PH_3$: phosphine
$H_2S$: hydrogen sulfide
$H_2Se$: hydrogenated selenium
$C_4H_6$: butadiene
$CF_4$: carbon tetrafluoride
$AsH_3$: arsine
$SiH_4$: monosilane.
$GeH_4$: germane
$B_2H_6$: diborane In Examples 10 to 75, after completion of the film formation, the power supply was discontinued, the regulator valve except for the one for hydrogen gas were all closed. Then, only the hydrogen gas was introduced into the reactor 733 at a flow rate of 200 sccm with a pressure of 20 Torr to decrease the temperature of the substrate to 30° C. for about 15 minutes. Further, the carrier gas from the first tank 701 was not a hydrogen but a helium has in Example 75.

Characteristics:

The photosensitive members obtained in Examples 10 to 75 have almost the same characteristics as that in Example 1 to 9. From these results, it can be understood that the photosensitive member having an overcoat layer of the present invention achieves durability without loss of image quality, and that it particularly provides superior performance in regard to moisture resistance after printing.

TABLE 3

| Ex No. | (1) sccm | (2) sccm | (3) sccm | (4) sccm | (5) sccm | (6) sccm | (7) °C. | (8) Torr | (9) °C. | (10) min | (11) watt | (12) min | (13) μm | (14) KHz | (15) at. % | (16) at. % | (17) at. % | (18) at. % | (19) |
|---|---|---|---|---|---|---|---|---|---|---|---|---|---|---|---|---|---|---|---|
| 10 | 300 | $C_3H_6$ | 30 $C_3F_6$ | 90 — | — — | $(CH_3)_3Al$ | 4 | 65 | 0.5 | 50 | 15 | 200 | 2 | 0.25 | 125 | 45 | F 2.7 | Al 2.5 | — — | A |
| 11 | | | | | | | same as Example 10 | | | | | | | | | | | | | B |
| 12 | | | | | | | same as Example 10 | | | | | | | | | | | | | C |
| 13 | | | | | | | same as Example 10 | | | | | | | | | | | | | D |
| 14 | 300 | $C_3H_6$ | 30 $C_3F_6$ | 90 — | — $PH_3$ | 2 $(CH_3)_3Al$ | 4 | 65 | 0.5 | 50 | 15 | 200 | 2 | 0.25 | 125 | 45 | F 2.7 | Al 2.5 | P 0.5 | E |
| 15 | | | | | | | same as Example 10 | | | | | | | | | | | | | F |
| 16 | | | | | | | same as Example 10 | | | | | | | | | | | | | G |
| 17 | | | | | | | same as Example 10 | | | | | | | | | | | | | H |
| 18 | | | | | | | same as Example 10 | | | | | | | | | | | | | I |
| 19 | 300 | $C_3H_6$ | 30 $CF_4$ | 90 $H_2S$ | 3 — | — — | — | — | 0.5 | 50 | 15 | 160 | 2 | 0.2 | 70 | 45 | F 3.7 | S 1.2 | — — | A |
| 20 | | | | | | | same as Example 19 | | | | | | | | | | | | | B |
| 21 | | | | | | | same as Example 19 | | | | | | | | | | | | | C |
| 22 | | | | | | | same as Example 19 | | | | | | | | | | | | | D |
| 23 | 300 | $C_3H_6$ | 30 $CF_4$ | 90 $H_2S$ | 3 $PH_3$ | 3 — | — | — | 0.5 | 50 | 15 | 160 | 2 | 0.2 | 70 | 45 | F 3.7 | S 1.2 | P 0.9 | E |
| 24 | | | | | | | same as Example 19 | | | | | | | | | | | | | F |
| 25 | | | | | | | same as Example 19 | | | | | | | | | | | | | G |
| 26 | | | | | | | same as Example 19 | | | | | | | | | | | | | H |
| 27 | | | | | | | same as Example 19 | | | | | | | | | | | | | I |
| 28 | 300 | $C_3H_6$ | 30 $C_3F_6$ | 90 $H_2Se$ | 4 — | — — | — | — | 0.5 | 50 | 15 | 200 | 2 | 0.25 | 125 | 45 | F 2.7 | Se 1.9 | — — | A |
| 29 | | | | | | | same as Example 28 | | | | | | | | | | | | | B |
| 30 | | | | | | | same as Example 28 | | | | | | | | | | | | | C |
| 31 | | | | | | | same as Example 28 | | | | | | | | | | | | | D |
| 32 | 300 | $C_3H_6$ | 30 $C_3F_6$ | 90 $H_2Se$ | 4 $PH_3$ | 2 — | — | — | 0.5 | 50 | 15 | 200 | 2 | 0.25 | 125 | 45 | F 2.7 | Se 1.9 | P 0.5 | E |
| 33 | | | | | | | same as Example 28 | | | | | | | | | | | | | F |
| 34 | | | | | | | same as Example 28 | | | | | | | | | | | | | G |
| 35 | | | | | | | same as Example 28 | | | | | | | | | | | | | H |
| 36 | | | | | | | same as Example 28 | | | | | | | | | | | | | I |
| 37 | 300 | $C_4H_6$ | 30 $CF_4$ | 90 $PH_3$ | 5 — | — — | — | — | 0.5 | 50 | 15 | 160 | 2 | 0.2 | 70 | 45 | F 3.7 | P 1.4 | — — | A |
| 38 | | | | | | | same as Example 37 | | | | | | | | | | | | | B |
| 39 | | | | | | | same as Example 37 | | | | | | | | | | | | | C |
| 40 | | | | | | | same as Example 37 | | | | | | | | | | | | | D |
| 41 | | | | | | | same as Example 37 | | | | | | | | | | | | | E |
| 42 | | | | | | | same as Example 37 | | | | | | | | | | | | | F |
| 43 | | | | | | | same as Example 37 | | | | | | | | | | | | | G |
| 44 | | | | | | | same as Example 37 | | | | | | | | | | | | | H |
| 45 | | | | | | | same as Example 37 | | | | | | | | | | | | | I |
| 46 | 300 | $C_3H_6$ | 30 $C_3F_6$ | 90 $AsH_3$ | 4 — | — — | — | — | 0.5 | 50 | 15 | 200 | 2 | 0.25 | 125 | 45 | F 2.7 | As 2.8 | — — | A |
| 47 | | | | | | | same as Example 46 | | | | | | | | | | | | | B |
| 48 | | | | | | | same as Example 46 | | | | | | | | | | | | | C |
| 49 | | | | | | | same as Example 46 | | | | | | | | | | | | | D |
| 50 | | | | | | | same as Example 46 | | | | | | | | | | | | | E |
| 51 | | | | | | | same as Example 46 | | | | | | | | | | | | | F |
| 52 | | | | | | | same as Example 46 | | | | | | | | | | | | | G |
| 53 | | | | | | | same as Example 46 | | | | | | | | | | | | | H |
| 54 | | | | | | | same as Example 46 | | | | | | | | | | | | | I |
| 55 | 300 | $C_4H_6$ | 30 $CF_4$ | 90 $SiH_4$ | 3 — | — — | — | — | 0.5 | 50 | 15 | 160 | 2 | 0.2 | 70 | 45 | F 3.7 | Si 3.7 | — — | A |
| 56 | | | | | | | same as Example 55 | | | | | | | | | | | | | B |
| 57 | | | | | | | same as Example 55 | | | | | | | | | | | | | C |
| 58 | | | | | | | same as Example 55 | | | | | | | | | | | | | D |
| 59 | 300 | $C_4H_6$ | 30 $CF_4$ | 90 $SiH_4$ | 3 $PH_3$ | 3 — | — | — | 0.5 | 50 | 15 | 160 | 2 | 0.2 | 70 | 45 | F 3.7 | Si 3.7 | P 0.8 | E |
| 60 | | | | | | | same as Example 55 | | | | | | | | | | | | | F |

TABLE 3-continued

| Ex No. | (1) sccm | | (2) sccm | | (3) sccm | | (4) sccm | | (5) sccm | | (6) sccm | (7) °C. | (8) Torr | (9) °C. | (10) min | (11) watt | (12) min | (13) μm | (14) KHz | (15) at. % | (16) at. % | | (17) at. % | | (18) at. % | | (19) |
|---|---|---|---|---|---|---|---|---|---|---|---|---|---|---|---|---|---|---|---|---|---|---|---|---|---|---|---|
| 61 | same as Example 55 | | | | | | | | | | | | | | | | | | | | | | | | | | G |
| 62 | same as Example 55 | | | | | | | | | | | | | | | | | | | | | | | | | | H |
| 63 | same as Example 55 | | | | | | | | | | | | | | | | | | | | | | | | | | I |
| 64 | 300 | $C_3H_6$ | 30 | $C_3F_6$ | 90 | $GeH_4$ | — | — | | — | — | — | 0.5 | 50 | 15 | 200 | 2 | 0.25 | 125 | 45 | F | 2.7 | Ge | 4.6 | — | — | A |
| 65 | same as Example 64 | | | | | | | | | | | | | | | | | | | | | | | | | | B |
| 66 | same as Example 64 | | | | | | | | | | | | | | | | | | | | | | | | | | C |
| 67 | same as Example 64 | | | | | | | | | | | | | | | | | | | | | | | | | | D |
| 68 | 300 | $C_3H_6$ | 30 | $C_3F_6$ | 90 | $GeH_4$ | 4 | $PH_3$ | 2 | — | — | — | 0.5 | 50 | 15 | 200 | 2 | 0.25 | 125 | 45 | F | 2.7 | Ge | 4.6 | P | 0.5 | E |
| 69 | same as Example 64 | | | | | | | | | | | | | | | | | | | | | | | | | | F |
| 70 | same as Example 64 | | | | | | | | | | | | | | | | | | | | | | | | | | G |
| 71 | same as Example 64 | | | | | | | | | | | | | | | | | | | | | | | | | | H |
| 72 | same as Example 64 | | | | | | | | | | | | | | | | | | | | | | | | | | I |
| 73 | 150 | $C_4H_6$ | 70 | $C_2F_4$ | 30 | $SiH_4$ | 10 | $H_2Se$ | 3 | — | — | — | 0.9 | 50 | 15 | 190 | 4.1 | 0.3 | 900 | 40 | F | 2.6 | Si | 3.9 | Se | 0.5 | A |
| 74 | 200 | $C_3H_6$ | 80 | $C_2F_4$ | 30 | $B_2H_6$ | 30 | $H_2Se$ | 8 | — | — | — | 0.8 | 50 | 15 | 180 | 3.8 | 0.25 | 200 | 41 | F | 3.1 | B | 0.7 | Se | 1.2 | B |
| 75 | 180 | $C_4H_6$ | 80 | $C_2Cl_4$ | 18 | $PH_3$ | 5 | $SiH_4$ | 12 | — | — | — | 0.7 | 50 | 15 | 170 | 5 | 0.19 | 1000 | 42 | Cl | 1.9 | P | 0.9 | Si | 4.1 | E |

COMPARATIVE EXAMPLES 10 to 18

Overcoat layers were formed on organic photosensitive layers as per Examples 1 to 9 except for omitting the inflow of diborane gas.

Evaluations after 10,000 copies, 50,000 copies, 100,000 copies or 250,000 copies, each test being conducted at 35° C. and $80_5$ relative humidity, was made, and it was understood from the result that the overcoat layers obtained in Comparative Examples 10 to 18 exhibited poor moisture resistance after printing as shown in Table 4 due to the absence of elements in Group III, thus confirming their impracticality. The results of these evaluations are shown in Table 4. In the table, the [E] mark indicates no evidence of image drift detected under conditions of 35° C. and 80% relative humidity; the [G] mark indicates partial image drift under identical conditions; the [B] mark indicates image drift throughout the entire copy under identical conditions.

COMPARATIVE EXAMPLES 19 to 27

Overcoat layers were formed on organic photosensitive layers as per Examples 10 to 18 except for omitting the inflow of perfluoropropylene gas.

The obtained test materials exhibited poor moisture resistance after printing as shown in Table 4 due to the absence of halogen atoms, thus confirming their impracticality.

COMPARATIVE EXAMPLES 28 to 36

Overcoat layers were formed on organic photosensitive layers as per Examples 1 to 9 except for omitting the inflow of tetrafluorocarbon gas and diborane gas.

The obtained test materials exhibited poor moisture resistance and produced image drift under high temperature conditions prior to use in resistance tests, thus confirming their impracticality.

COMPARATIVE EXAMPLES 37 to 45

Overcoat layers were formed on organic photosensitive layers as per Examples 1 to 9 except that the substrate temperature was set to 150° C.

Characteristics:

The photosensitive member of Comparative Example 41 using the organic photosensitive layer E showed E1/2 of 43 lux.sec, and any photosensitivity cannot be observed in other organic photosensitive members. These results indicate that the photosensitive member manufactured under the substrate temperature of 100° C. or less is usable.

COMPARATIVE EXAMPLES 46 to 54

Overcoat layers were formed on organic photosensitive layers as per Examples 1 to 9 except that 300-watt power with a frequency of 13.56 MHz was applied to the power application electrode.

However, powder particles were produced on the photosensitive layers, failing to form overcoat layers.

COMPARATIVE EXAMPLES 55 to 63

Overcoat layers were formed on organic photosensitive layers as per Examples 1 to 9 except that 50-watt power with a frequency of 500 KHz was applied to the power application electrode.

However, glow discharge was not produced under such a condition, failing to form overcoat layers.

TABLE 4

| Example | No. Copies 10,000 | No. Copies 50,000 | No. Copies 100,000 | No. Copies 250,000 |
|---|---|---|---|---|
| Com. Ex. 10 | E | G | B | B |
| Com. Ex. 11 | E | G | B | B |
| Com. Ex. 12 | E | G | B | B |
| Com. Ex. 13 | E | G | B | B |
| Com. Ex. 14 | G | B | B | B |
| Com. Ex. 15 | E | G | B | B |
| Com. Ex. 16 | E | G | B | B |
| Com. Ex. 17 | E | G | B | B |
| Com. Ex. 18 | E | G | B | B |
| Com. Ex. 19 | G | B | B | B |
| Com. Ex. 20 | G | B | B | B |
| Com. Ex. 21 | G | B | B | B |
| Com. Ex. 22 | G | B | B | B |
| Com. Ex. 23 | B | B | B | B |
| Com. Ex. 24 | G | B | B | B |
| Com. Ex. 25 | B | B | B | B |
| Com. Ex. 26 | G | B | B | B |
| Com. Ex. 27 | G | B | B | B |

What is claimed is:

1. A photosensitive member comprising:

an electrically conductive substrate;

a photoconductive layer comprising an organic material; and an overcoat layer formed on said photoconductive layer and comprising amorphous carbon containing hydrogen, said overcoat layer containing halogen atoms and at least one or more elements selected from the group consisting of chalcogen and elements of Group III, IV and V of the periodic table, wherein the amount of said chalcogen is about 0.01 to about 20 atomic %, the amount of said elements of Group III is about 0.01 to about 20 atomic %, the amount of said elements of Group IV is about 0.01 to about 40 atomic % and the amount of said elements of Group V is about 0.01 to about 20 atomic %, each amount based on all constituent atoms therein.

2. A photosensitive member as claimed in claim 1 wherein the amount of the hydrogen contained in the overcoat layer is about 5 to about 50 atomic % based on the combined amount of hydrogen and carbon therein.

3. A photosensitive member as claimed in claim 1 wherein the amount of the chalcogen contained in the overcoat layer is preferably about 0.1 to about 10 atomic % based on all the constituent atoms therein.

4. A photosensitive member as claimed in claim 1 wherein the amount of the elements in Group III of the periodic table contained in the overcoat layer is preferably about 0.1 to about 10 atomic % based on all the constituent atoms therein.

5. A photosensitive member as claimed in claim 7 wherein the amount of the elements in Group IV of the periodic table contained in the overcoat layer is preferably about 0.1 to about 15 atomic % based on all the constituent atoms therein.

6. A photosensitive member as claimed in claim 1 wherein the amount of the elements in Group V of the periodic table contained in the overcoat layer is preferably about 0.1 to about 10 atomic % based on all the constituent atoms therein.

7. A photosensitive member as claimed in claim 1 wherein the amount of the halogen atoms contained in the overcoat layer is about 0.01 to about 50 atomic % based on all the constituent atoms therein.

8. A photosensitive member as claimed in claim 1 wherein the amount of the halogen atoms contained in the overcoat layer is preferably about 0.1 to about 10 atomic % based on all the constituent atoms therein.

9. A photosensitive member as claimed in claim 1 wherein said overcoat layer is prepared by organic plasma polymerization.

10. A photosensitive member as claimed in claim 1 wherein the thickness of the overcoat layer is about 0.01 to about 5 microns.

11. A process for preparing a photosensitive member comprising:

a first step of forming a photoconductive layer on an electrically conductive substrate, said photoconductive layer comprising an organic material;

a second step of heating the substrate on which the photoconductive layer is formed to a temperature not exceeding 100° C.;

a third step of introducing gaseous materials containing halogen atoms and materials containing at least one or more elements selected from the group of chalcogen atoms, elements in Group III, IV and V of the periodic table into a reaction chamber; and a fourth step of applying electric power with a frequency of about 1 KHz to 1 MHz to cause glow discharge in the reaction chamber to thereby form an overcoat layer on the photoconductive layer, said overcoat layer comprising amorphous carbon containing hydrogen, and said overcoat layer containing halogen atoms and one or more elements selected from the group consisting of chalcogen and elements in Group III, IV and V of the periodic table, wherein the amount of said chalcogen is about 0.01 to about 20 atomic %, the amount of said elements of Group III is about 0.01 to about 20 atomic %, the amount of said elements of Group IV is about 0.01 to about 40 atomic % and the amount of said elements of Group V is about 0.01 to about 20 atomic %, each amount based on all constituent atoms therein.

* * * * *

UNITED STATES PATENT AND TRADEMARK OFFICE

CERTIFICATE OF CORRECTION

PATENT NO. : 4,902,595

DATED : February 20, 1990

INVENTOR(S) : Kenji MASAKI, et al.

It is certified that error appears in the above-identified patent and that said Letters Patent is hereby corrected as shown below:

On the title page, item [54] and in column 1, line 3:
In the title, sixth word is changed from "LYER" to --LAYER--

Signed and Sealed this

Twenty-third Day of July, 1991

*Attest:*

*Attesting Officer*

HARRY F. MANBECK, JR.

*Commissioner of Patents and Trademarks*